United States Patent [19]

Pretorius

[11] 4,127,270

[45] Nov. 28, 1978

[54] OCCUPATIONAL GAMES EQUIPMENT

[75] Inventor: Willem J. Pretorius, Roodepoort, South Africa

[73] Assignee: Lenbo Investments (Proprietary) Limited, Johannesburg, South Africa

[21] Appl. No.: 773,409

[22] Filed: Mar. 1, 1977

[30] Foreign Application Priority Data

Mar. 3, 1976 [ZA] South Africa ..... 76/1287

[51] Int. Cl.[2] ..... A63B 67/10

[52] U.S. Cl. ..... 273/97 R

[58] Field of Search ..... 273/97 R, 98, 95 R, 273/95 A, 95 G

[56] References Cited

U.S. PATENT DOCUMENTS

| | | | |
|---|---|---|---|
| 1,017,376 | 2/1912 | Brandt | 273/97 R |
| 1,538,720 | 5/1925 | Mercer | 273/97 R X |
| 1,944,628 | 1/1934 | Barker | 273/97 R |
| 2,089,652 | 8/1937 | Kelly | 273/97 R |
| 2,105,462 | 1/1938 | Brinkman | 273/97 R |
| 2,792,225 | 5/1957 | Coursey | 273/97 R |
| 3,157,400 | 11/1964 | Schmid | 273/97 R |
| 4,040,623 | 8/1977 | Ott | 273/98 |

*Primary Examiner*—William H. Grieb

*Attorney, Agent, or Firm*—Cushman, Darby & Cushman

[57] ABSTRACT

This invention relates to occupational games equipment which comprises a bat, an elongated substantially rigid member extending away from the bat in a direction substantially opposite to the handle of the bat, and an attachment point at or near that free end of the elongated member for one end of a flexible element carrying a ball at its other end.

7 Claims, 10 Drawing Figures

Fig 1.
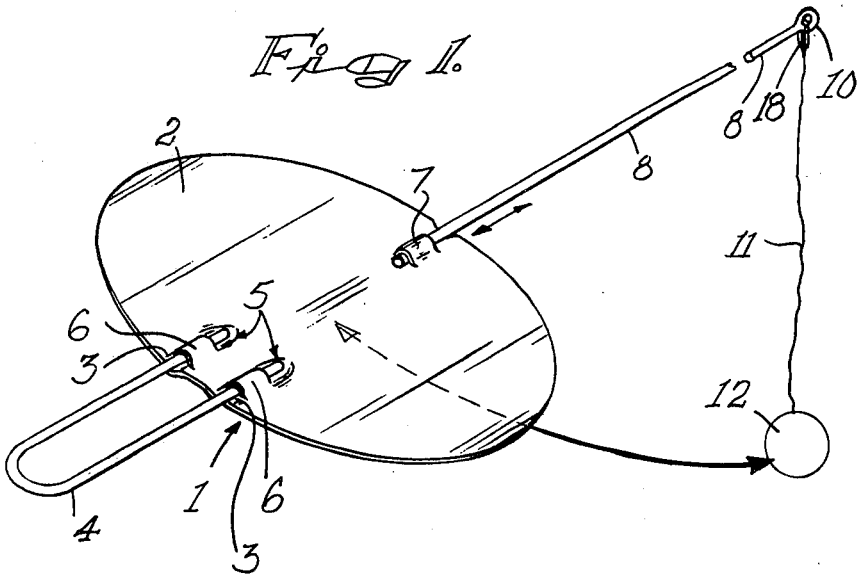
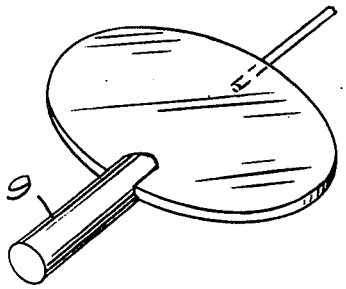
Fig 2.
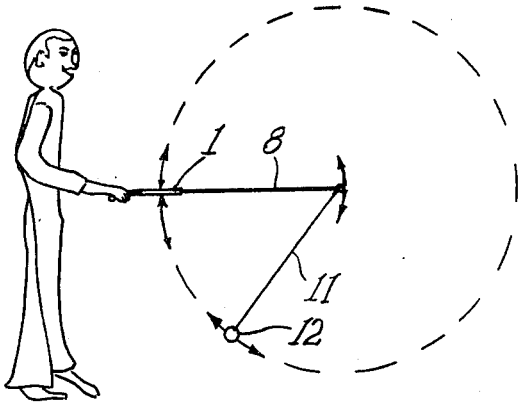
Fig 3.

OCCUPATIONAL GAMES EQUIPMENT

This invention relates to occupational games equipment of the type generally adapted to be used by a single person at one time but which may also be used by two persons for certain purposes.

It is the object of this invention to provide novel occupational games equipment which will have an element of challenge and occupational value.

In accordance with this invention there is provided occupational games equipment comprising a bat, an elongated substantially rigid member extending away from the bat in a direction substantially opposite to the handle of the bat, and an attachment point at or near the free end of the elongated member for one end of a flexible element carrying a ball at its other end.

Further features of the invention provide for the elongated member to be resilient and for it to be releasably attached to the bat, for the free end of the elongated member to be formed into an eye and for the bat head to be of an elongated shape in a direction transverse to the elongated member.

Still further features of the invention provide for the bat to be made of metal plate pressed and punched to provide, in effect, sockets for receiving spigots associated with a handle and a socket for receiving the elongated member, and for the handle to comprise a bent length of wire in the form of an elongated U-shape whereof the free ends of the arms of the U engage in sockets provided therefor in the bat head.

For use, the length of the flexible element, which is conveniently a woven synthetic fibre string, may be adjusted so that the ball will strike roughly the centre of the bat head when the element is taught and attached to the attachment point of the elongated member. However, in some cases a greater length may be desired as will be more apparent from the following.

The invention will be further described with reference to the accompanying drawings in which:

FIG. 1 is an isometric view of occupational games equipment according to the invention;

FIG. 2 illustrates in similar view an alternative bat; and,

FIG. 3 to 10 illustrate various ways in which the equipment may be utilised.

Figure 4:
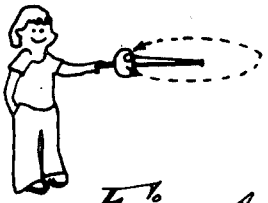

As illustrated in FIG. 1 the games equipment may comprise a bat 1 having a bat head 2 constituted by a cut metal plate suitably finished off by painting, epoxy coating, nylon coating, baked enamel or any other desired finish. The bat head is die stamped to provide at one side thereof a pair of spaced socket formations 3, each of which receives one free end (constituting a spigot) of an elongated U-shaped length of wire or the like which defines a handle 4. Each socket is defined by a groove 5 pressed into the metal and a cut transverse strip 6 bent to a grooved configuration in the opposite direction. A similar socket formation 7 is located opposite the handle to receive one end (constituting a spigot) of a metal wire or rod 8 extending in a direction opposite to the handle. This wire or rod is preferably somewhat resilient and has a convenient length of the order of 400 to 500 mm. The bat head is preferably oval or elongated in a direction transverse to the wire or rod, and the latter is preferably a releasable frictional fit in its socket.

As shown in FIG. 2 the bat may be of more conventional construction such as wood or plastics in which case the handle 9 is of conventional cylindrical shape.

The free end of the rod or wire is formed into an eye 10 to which is tied a flexible string 11 or the like carrying at its other end a resilient ball 12. Alternatively, it may be preferable to attach the string to a closed ring 18 and install the ring on the eye whereafter the latter is bent to close it. The length of the string may be sufficiently great to enable all of the following ways of using the equipment to be carried out using a single length of string, or alternatively an additional length of string can be provided to enable the method of operation illustrated in FIG. 10 to be carried out. Suitable releasable connections can be provided for connecting the different strings together and also to the eye if required. Alternatively, two separate balls having different lengths of string attached thereto may be provided.

In either case one method of using the equipment is illustrated clearly in FIG. 3 and in this case the string 11 is adjusted or made to such a length that with the string in a straight condition the ball can strike the bat approximately centrally. The game is played by causing the ball to move in a circular arc about the eye to strike the bat say on the top surface thereof, and to move back and strike the bat on the undersurface, and so on as illustrated.

Figure 5:
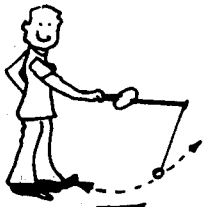
Figure 6:
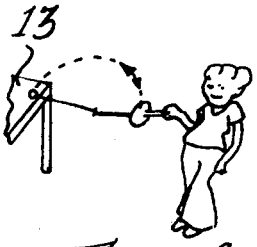
Figure 7:
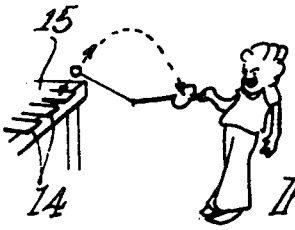

Other methods of using this equipment include causing the ball to move in a horizontal arc (as illustrated in FIG. 4); causing the ball to strike an upper face of the bat and then the underneath of a person's shoe etc. (FIG. 5); causing the ball to strike an upper face of the bat and then a table top 13, for example (FIG. 6); or aiming the ball during use as described with reference to FIG. 3 at projecting cards 14 supported on a table edge 15 (FIG. 7).

Figure 8:
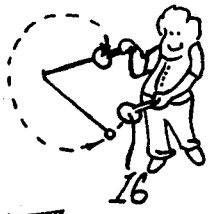
Figure 9:
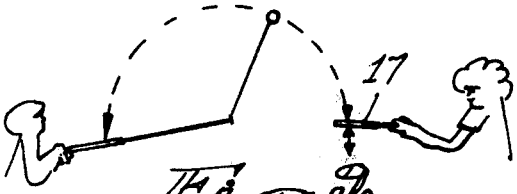

A second bat 16 without an elongated member may be provided in which case the ball could be struck first with one bat and then with the other (FIG. 8). A second person could hold a second bat 17 with which he could hit the ball "back" to the first person as illustrated in FIG. 9.

Figure 10:
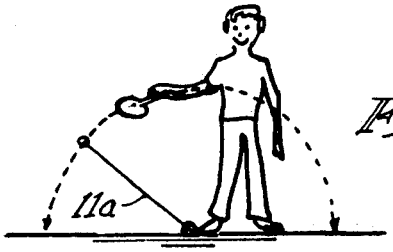

An alternative method of using the equipment is to release the rod 8 from the bat and attach a ball to the eye of the rod by means of a substantially longer string 11*a*. The end of the rod opposite the eye may then be anchored to the ground by means of a person's foot and the ball hit by means of the bat such that it follows a semi-circular path above the ground with the ball rebounding from the ground as indicated in FIG. 10.

It will be appreciated that the invention provides occupational games equipment which it is considered will be challenging and stimulating, particularly to children.

What I declare as new and desire to secure by Letters Patent is:

1. Occupational games equipment, comprising:

a bat, including a generally disk-shaped head having two opposite faces, and a generally radially outwardly extending handle secured to the bat head;

an elongated, substantially rigid but somewhat resilient rod member having two opposite ends;

means securing said rod member adjacent one end thereof to the bat head so as to project radially outwardly therefrom, substantially in diametrical opposition to said handle, said rod member having means defining an attachment point, distally of said bat head, adjacent the opposite end of said rod member;

a resilient ball;

a flexible but axially substantially inextensible string element having two opposite ends, said string element being connected at one said end to said ball and at the other said end to said attachment point, said string element being of such length that when said string element is fully extended, said ball tethered thereby is positioned to alternatively strike either face of said bat head generally centrally of such face.

2. The occupational games equipment of claim 1, wherein:

said securing means is constituted by respective releasably connected elements on said bat head and said rod member one end, so that the rod member may be detached from and reattached to said bat head at will.

3. The occupational games equipment of claim 2, wherein:

said bat head is constituted by a metal plate having means providing a radially outwardly opening socket pressed therein for axially receiving said one end of said rod member with an interference fit, so that the rod member is frictionally, removably held in said socket, said socket and said one end of said rod member thereby providing said releasably connected elements of said securing means.

4. The occupational games equipment of claim 3, wherein:

said handle includes means defining at least one radially inwardly projecting spigot;

said metal plate further includes a radially outwardly opening handle-mounting socket pressed therein for each said spigot;

each respective spigot being axially received in a respective handle-mounting socket with an interference fit for mounting the handle to the bat head.

5. The occupational games equipment of claim 4, wherein:

said handle is constituted by a U-shaped length of wire having two said spigots, each being axially received in a respective handle-mounting socket with an interference fit, thereby mounting the U-shaped wire handle to the metal plate bat head.

6. The occupational games equipment of claim 1, wherein:

said attachment point comprises an eye formed at said opposite end of said rod member.

7. The occupational games equipment of claim 1, wherein:

said bat head is of generally oval figure, with the greatest diameter thereof oriented generally transversally relative to the length of said rod member.

* * * * *